United States Patent [19]

McCabe

[11] Patent Number: 4,884,379

[45] Date of Patent: Dec. 5, 1989

[54] SKYLIGHT STRUCTURE AND METHOD OF MANUFACTURE THEREFOR

[75] Inventor: Lance C. McCabe, San Clemente, Calif.

[73] Assignee: Bristol Fiberlite Industries, Inc., Santa Ana, Calif.

[21] Appl. No.: 158,452

[22] Filed: Feb. 22, 1988

[51] Int. Cl.[4] ..... E04B 7/18; E06B 7/08

[52] U.S. Cl. ..... 52/200; 52/473; 98/42.14; 98/121.1

[58] Field of Search ..... 52/198, 200, 60, 811, 52/814, 473, 97, 785, 794, 802, 803, 810, 815; 98/42.14, 121.1

[56] References Cited

U.S. PATENT DOCUMENTS

| | | | |
|---|---|---|---|
| 412,313 | 10/1889 | Weis et al. | 98/42.14 X |
| 1,678,748 | 7/1928 | Smith | 98/121.1 X |
| 2,507,578 | 5/1950 | Schilperoort | 52/801 X |
| 2,566,156 | 8/1951 | Apolonio | 98/42.14 |
| 2,990,923 | 7/1961 | Macias-Sarria | 52/473 |
| 3,086,442 | 4/1963 | Waldron | 98/121.1 |
| 3,267,834 | 8/1966 | Hockett | 98/121.1 |
| 3,756,138 | 9/1973 | Box | 98/121.1 |

*Primary Examiner*—David A. Scherbel
*Assistant Examiner*—Anthony W. Williams
*Attorney, Agent, or Firm*—Leonard Tachner

[57] ABSTRACT

A louvered skylight enclosure and method of manufacture therefor employ a plurality of louvered panels each made of at least two sections. Each such section is made from a cut planar member having aligned angled louvers which are placed in aligned contiguous engagement to form elongated louvers which prevent precipitation from entering the enclosure by precluding direct horizontal paths between the louvers. Use of planar members in the initial step of the method enables more efficient and lower cost fabrication.

7 Claims, 5 Drawing Sheets

SKYLIGHT STRUCTURE AND METHOD OF MANUFACTURE THEREFOR

BACKGROUND OF THE INVENTION

1. Field of the Invention

The present invention relates generally to skylight structures and more particularly, to a improved louvered skylight structure of the type typically mounted on the roof of a building and having a transparent or translucent material for allowing light to enter the building while also providing a plurality of louvers for permitting warm air, steam or other gases to rise through and exit the building through the fixed open louvers of the skylight structure.

2. Prior Art

The use of louvered skylight structures on the roofs of buildings for the purpose herein described is not per se new. The manifest advantages of having a skylight structure which allows light to pass into the building while simultaneously permitting warm air, steam or other gases to rise through the skylight structure and exit the building therethrough are readily apparent. The natural convective cooling provided by the use of such louvered skylight structures, particularly on the roofs of industrial buildings where heat or collected fumes might otherwise detrimentally affect the environment of the workers within the building, is highly advantageous. Such louvered skylight structures are typically of a substantially rectangular box-like shape, the bottom of which is secured to the roof adjacent the perimeter of an aperture through the roof and the top of which is enclosed by a transparent or translucent material which allows direct or diffused sunlight to enter the building through the structure. A plurality of louvers typically extending along the length of the sides of the box structure are normally provided to allow the passage of warm air, fumes or other gases to be convectively exited from the building through the skylight structure to the ambient environment. It is, of course, highly desirable to provide the aforementioned louvers in a configuration which while allowing he exiting of warm air and other such gases from the building, precludes the passage of precipitation such as rain, snow and the like from entering the building through the louvers.

In order to prevent such louvers from allowing precipitation to enter the building, it is necessary for the length and angle of the louvers to be such that there be no direct horizontal path through the louvers which would otherwise permit precipitation to enter the building particularly when there is also a strong horizontally directed wind such as during a gale storm or hurricane. While it is well recognized in the prior art to provide a louvered skylight structure wherein the angle and length of the louvers are sufficient to preclude such direct horizontal paths through the louvered structure, this louver configuration requirement has heretofore precluded one particularly cost effective and efficient method of manufacturing louvered panels to be used in such skylight structure. Specifically, it would be most cost effective and efficient to simply stamp out planar louvered side panels wherein the louvered portions thereof can be readily bent by appropriate machinery to assume the proper angle relative to the planar member to provide the exiting path therethrough. However, such a simplified manufacturing process inherently produces horizontal paths which result in the aforementioned undesirable precipitation induced leakage into the building through the skylight structure.

There has, therefore, been a long-felt need for a louvered skylight structure and method of manufacturing therefor which while permitting the most cost effective and efficient means of production of the structure's louvered side panel; namely, simply stamping out the side panels and bending the louvers to the appropriate angle; also precludes the aforementioned horizontal path problem which would permit the entry of water or other precipitation into the building through the louvered skylight structure particularly during a high velocity wind condition.

SUMMARY OF THE INVENTION

The present invention solves the aforementioned long-felt need by providing a novel louvered skylight structure and method of manufacture therefor which exploits the simple low cost process of stamping out the louvered side panels and bending the louvers into the appropriate angle. However, in the present invention this can be done while still resulting in a panel structure wherein the louvers are of sufficient length to preclude any horizontal paths through the side panels which might otherwise produce precipitation leakage into the building upon which the skylight structure is mounted. More specifically, the louvered panel of the present invention is uniquely configured with two initially separate sections, each of which contributes to the overall louver configuration when they are joined together in the manner to be described hereinafter. By utilizing the novel panel sections of the present invention, each such section may be made by starting initially with a flat pattern which may be readily stamped into the desired configuration. The sections may then be folded by conventional metal bending machinery and then joined to form a single panel having louvers extending at the appropriate angle and over the appropriate length to preclude the aforementioned horizontal path problem thereby preventing leakage of precipitation into the building through the louvered skylight structure as heretofor described. As used herein the term "horizontal" refers to the direction perpendicular to the panels of the invention.

Each of the aforementioned sections of each panel is provided with at least one perpendicularly bent end flange or margin which readily facilitates affixing the two sections together by means such as welding, brazing and the like. In a preferred embodiment of the invention disclosed herein each such section also provides an identical number of louver members at the same angle and positioned to be joined together in an overlapping, interlocking fashion so that the louvers in each such panel are formed by a combination of louver portions from each such section. The overlapping and interlocking louver portions, in combination, produce louvers which are longer than those which could be made by stamping out a single section in the manner described above. Consequently, each such louver extends sufficiently to preclude any of the aforementioned horizontal paths through the completed structure. A plurality of the aforementioned panels are then joined together using appropriate corner assembly brackets which, in a preferred embodiment, results in a rectangularly-shaped structure which is far less expensive and time consuming to produce. As a result the cost of the louvered skylight structure of the present invention may be reduced to the ultimate consumer thereby making it possible for the advantageous louvered design thereof to be utilized by a greater segment of the general public which contributes to improvement of the lighting and breathing environment in many factories and other industrial-type buildings.

The novel process of the present invention comprises the following steps:

(1) Stamping or cutting a flat pattern of a suitable material such as aluminum sheet to form the respective sections of each panel;

(2) bending each such section to form the louver portions and side members;

(3) interconnecting the louver portions of the respective sections of each panel wherein said contiguous side members are in overlapping engagement;

(4) permanently affixing the respective sections of each panel together by means of welding, brazing and the like;

(5) interconnecting respective panels at the appropriate angles to form an assembled louvered skylight structure; and (6) installing the skylight light transmitting material onto the louvered structure to provide a completed skylight.

OBJECTS OF THE INVENTION

It is therefore a principal object of the present invention to provide a novel, louvered skylight structure for installation primarily on the roofs of buildings, the louvered structure providing means for allowing warm air, fumes and other gases to rise through the building and escape through the structure's louvers while simultaneously precluding entry into the building through said louvers of precipitation even during wind storms.

It is an additional object of the present invention to provide an improved louvered skylight structure as described above and which is of novel structural configuration permitting fabrication by low cost and efficient metal stamping process while still avoiding the use of louvered configurations which would otherwise provide a horizontal path through the louvers defeating the precipitation leakage prevention feature previously described.

It is still an additional object of the present invention to provide an improved louvered skylight structure comprising a panel member having at least two sections each providing a portion of the aforementioned louvers and which, when joined, cooperate to provide louvers of sufficient length to preclude horizontal paths which might otherwise allow precipitation to leak into the louvered structure.

It is still an additional object of the present invention to provide an improved process for manufacturing a louvered skylight structure including the initial step of stamping out the sections of the walls of the structure to achieve a reduction in cost and time for manufacture, but without resulting in a louvered design which would permit the leakage of precipitation in through the structure because of the presence of horizontal paths through the louvers.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken into conjunction with the following drawings in which.

DESCRIPTION OF A PREFERRED EMBODIMENT

Figure 1:
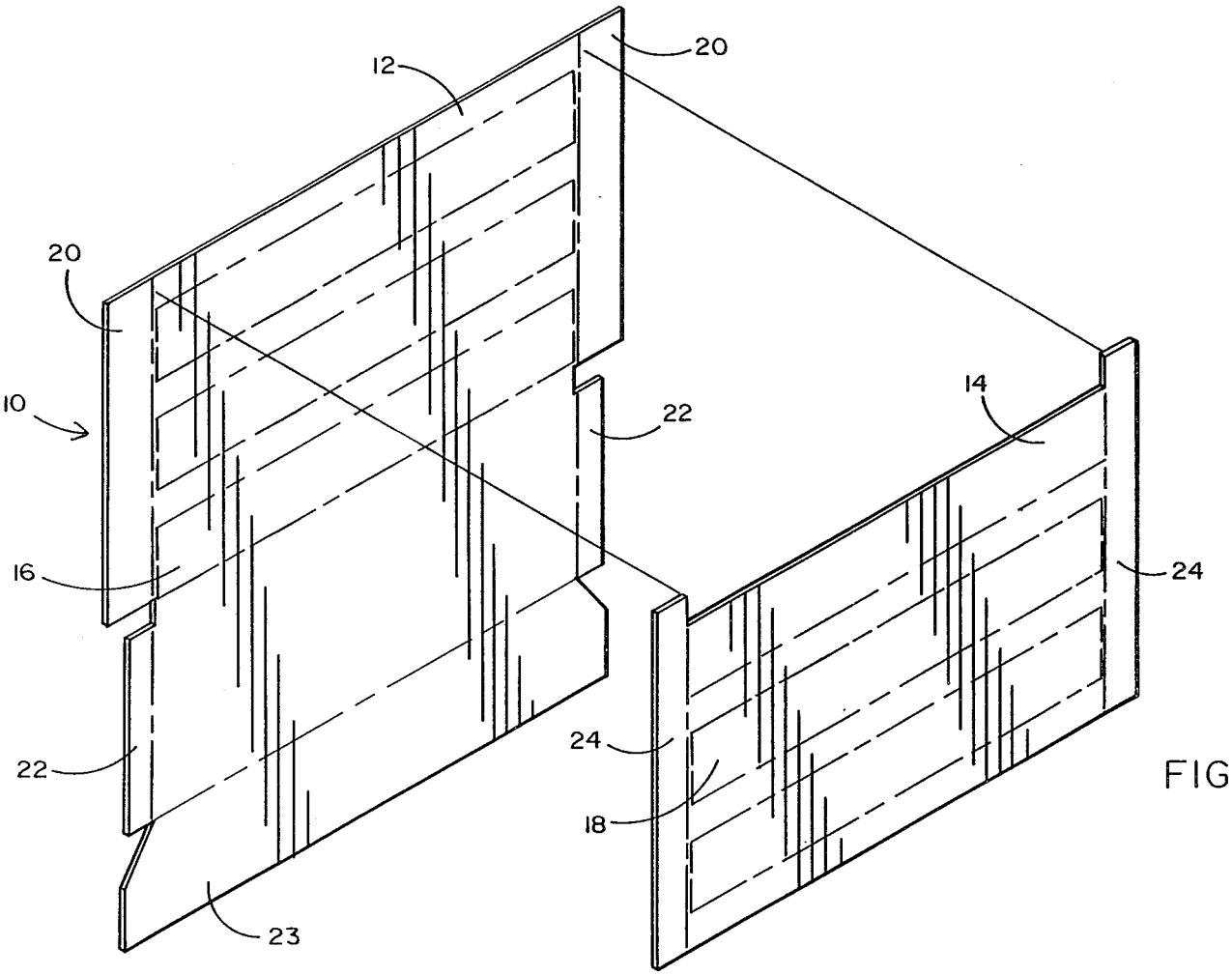
FIG. 1 is an isometric view of the two panel member sections that may be stamped out of flat metal sheets in accordance with the present invention.

Referring first to FIG. 1 it will be seen that the panel 10 of the present invention initially comprises two flat cutout sections of thin metal material such as aluminum including a main section 12 and an extension section 14. Main section 12 is preferably stamped to provide cut louvered portions 16 while extension section 14 is preferably stamped to provide cut louvered portions 18. Main section 12 also includes a pair of outer side members 20 and may initially include a pair of inner side members 22 and a bottom member 23. Similarly, extension section 14 is cut to provide a pair of extension side members 24. Inner side members 22 of main section 12 are optional strength adding portions which may be entirely omitted inasmuch as one or both of the inner side members 22 must eventually be removed from main section 12 to permit joining adjacent panels to one another.

Figure 2:
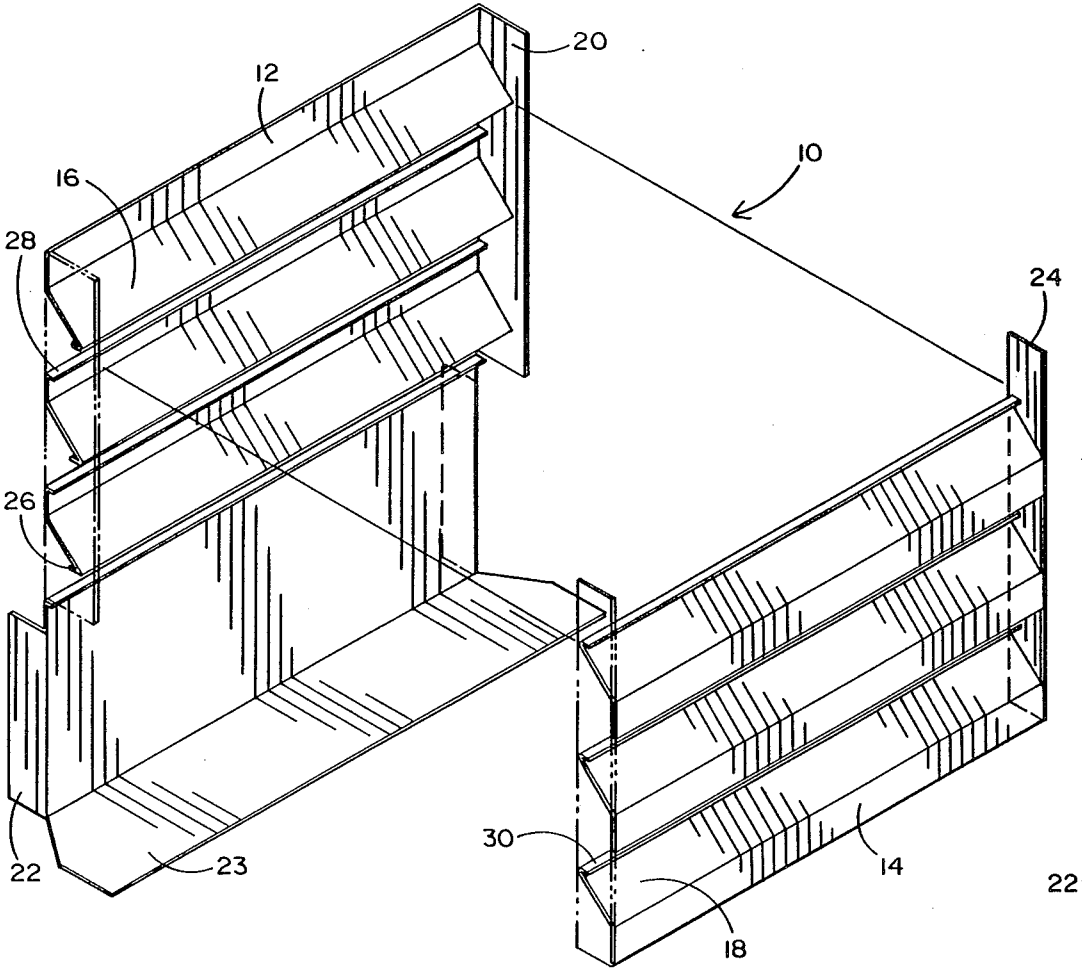
FIG. 2 is an exploded view of the two panel member sections after they have been folded into their final louvered configuration, but before they have been joined.

After the main section 12 and extension section 14 are stamped and cut as illustrated in FIG. 1, the louvers and side members are bent to the configuration illustrated in FIG. 2. As seen in FIG. 2, the louvered portions 16 are each bent outwardly to an angle of approximately 45 degrees relative to the plane of the main section while outer side members 20 and bottom member 23 are each bent 90 degrees outwardly relatively to the main section plane. Inner side members 22, if they are included, are bent 90 degrees relative to the plane in an inward direction. As used herein the term "outwardly" means directed away from the aperture about which the skylight structure of the present invention is mounted when installed and "inwardly" means toward the center of the completed skylight structure.

The various louvered portions and side members of extension section 14 are also bent in the manner illustration in FIG. 2. More specifically, louvered portions 18 are bent inwardly at substantially the same angle as the corresponding louvered portions 16 of the main section 12. In addition, extension side members 24 are bent inwardly 90 degrees to provide a mating surface with the corresponding outer side members 20 of the main section 12. As also seen in FIG. 2, the louver portion 16 of the main section are provided with a lower lip 26 and an upper lip 28 while the corresponding louvered portions 18 of the extension section 14 are provided with an upper lip 30. As will be seen hereinafter, the lower lips of the main section 12 and the upper lips of the extension section 14 are designed to interlock to provide a substantially continuous louver when the sections 12 and 14 are joined in the manner to be described hereinafter. On the other hand, upper lip 28 of the main section 12 is designed to add additional strength and resistance to bending and torsion of the panel 10.

Figure 3:
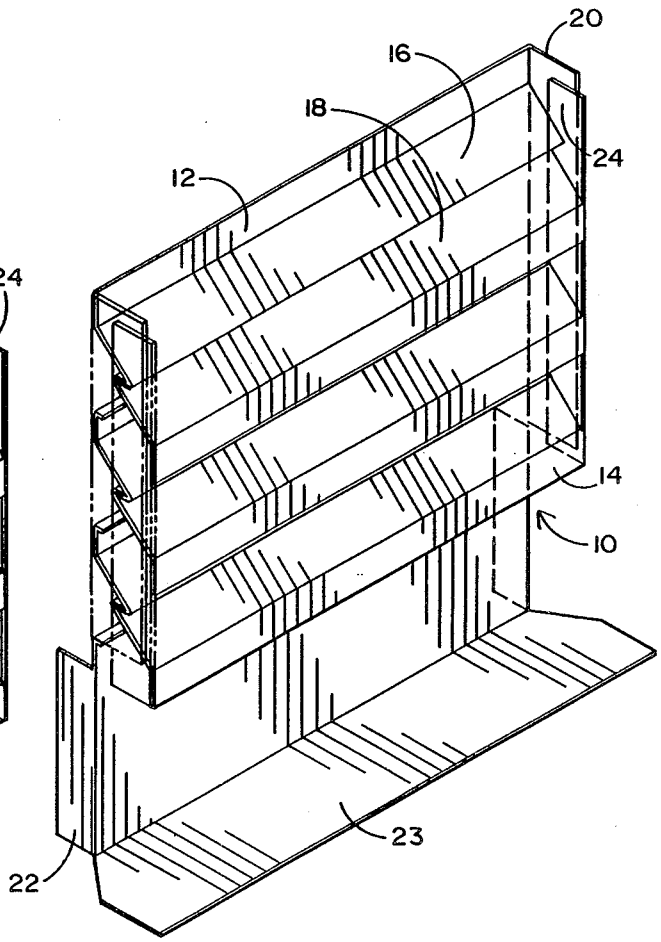
FIG. 3 is an isometric view of the panel member of the present invention showing the two separate sections joined to form a unitary panel member.

FIG. 3 illustrates the configuration of panel 10 when the main section 12 and extension section 14 are joined. As seen in FIG. 3 the outer side panels 20 of main section 12 and extension side members 24 of extension section 14 are in substantially contiguous engagement. The lateral dimension of the sections is appropriately selected to avoid any interference between the respective side members. In addition it will be seen that each lower lip 26 of the louvered portion 16 of main section 12 is interlocked with an upper lip 30 of extension section 14 so that the louver portion 16 and louver portion 18 of the respective sections are, in effect, joined to form a continuous louver which would preclude the passage of any form of precipitation therebetween. It is preferable to secure the main section 12 and extension section 14 of each panel to one another by brazing or welding the outer side members 20 to the extension side members 24. It is generally unnecessary to provide any additional means for affixing the respective sections to one another such as by welding along the respective interlocked lips 26 and 30.

Figure 4:
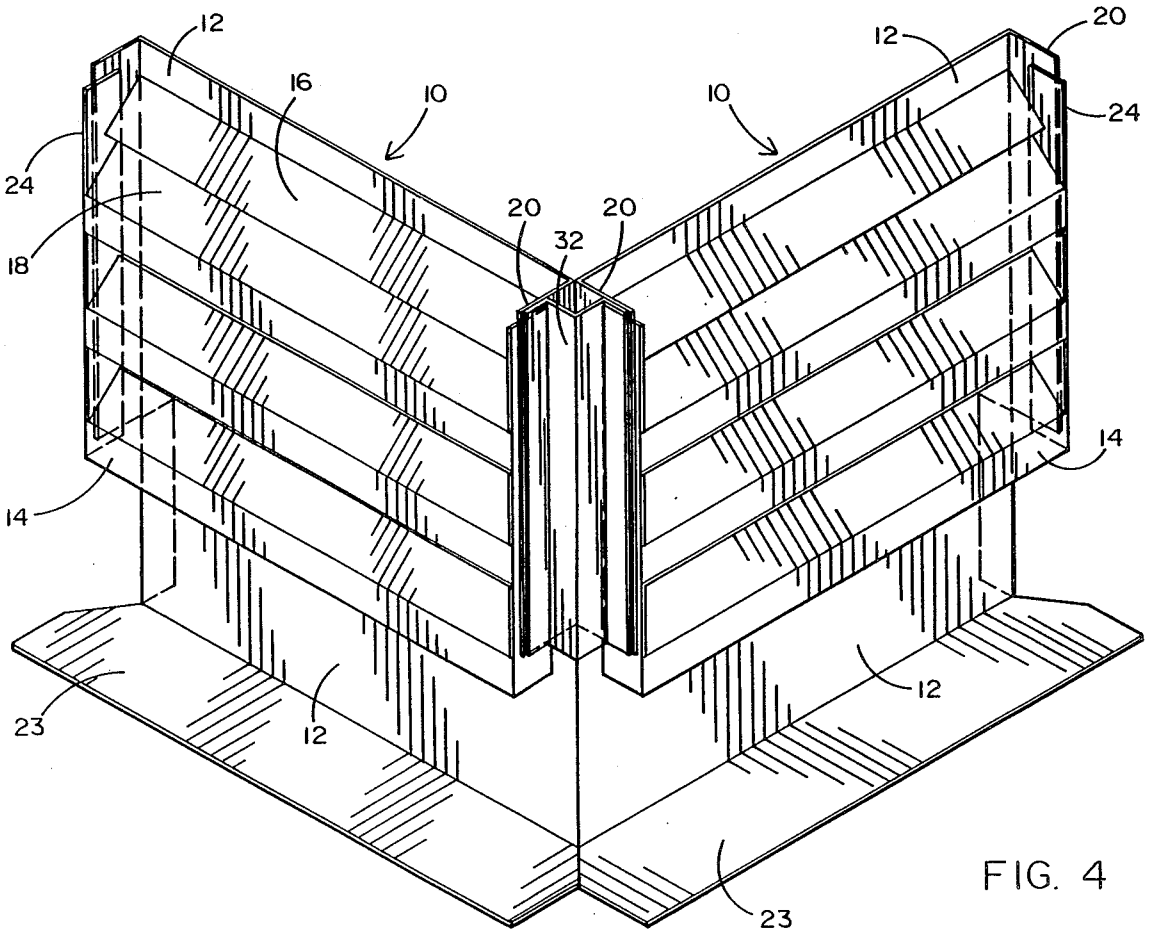
FIG. 4 is an isometric view of two such panel members joined together at 90 degrees to form one-half of the box-like structure of the present invention.

FIG. 3 represents a completed panel 10 which is ready for interconnection to an adjoining side panel 10 in the manner illustrated in FIG. 4, with one or both of the inner side members 22 of the extension section 14 removed. The shaped mitre on both sides of bottom member 23 of extension section 14 permits the positioning of two panels 10 in perpendicular relation in the manner illustrated in FIG. 1. It is preferable to provide an interconnection bracket 32 shown in FIG. 4 which may also be welded or brazed to the sides of outer side members 20. It will be understood that a complete box-like structure may be readily assembled simply by arranging four panels 10 each as one side of a rectangular structure and all joined to their adjacent panels by means such as interconnection bracket 32. It will also be understood that although the illustrated embodiment contemplates providing rectangular configurations of skylight structures utilizing four panels 10, other numbers of panels may be joined at angles other than 90 degrees by simply altering the shape of interconnection bracket 32. To accommodate non-perpendicular relationships, of course, the mitre angle of bottom member 23 would also be altered accordingly. It should also be understood that although FIG. 4 shows two adjacent panels of substantially equal dimensions which would create a square structure, the lateral dimension of each such panel may be altered relative to the next whereby to provide a rectangular structure having two pairs of panels, each such pair being of different lateral dimension.

Figure 6:
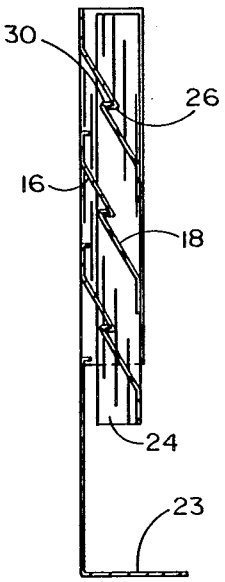
FIG. 6 is a side view of the panel member of the present invention similar to that of FIG. 5 but showing the sections of the panel member being joined.
Figure 5:
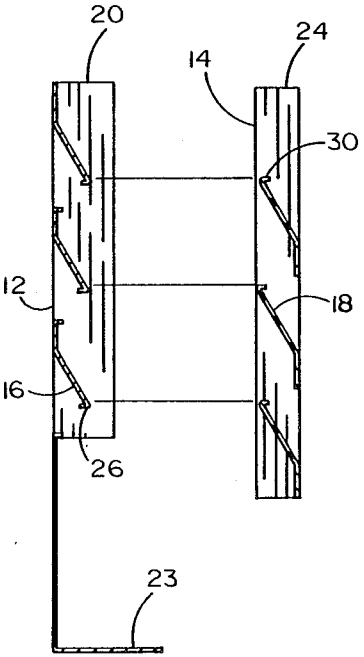
FIG. 5 is an exploded side view of the panel member of the present invention showing the manner in which the respective louvered portions thereof are configured just prior to their being joined.

The manner in which the main section 12 and extension section 14 of each panel 10 may be easily joined in an assembly corresponding to a completed panel is illustrated in FIGS. 5 and 6. These cross-sectional views clearly indicate the interlocking lip configuration of the two sections of the panel and the relative position and geometry of the side members 20 and 24 of the respective sections when joined.

Figure 7:
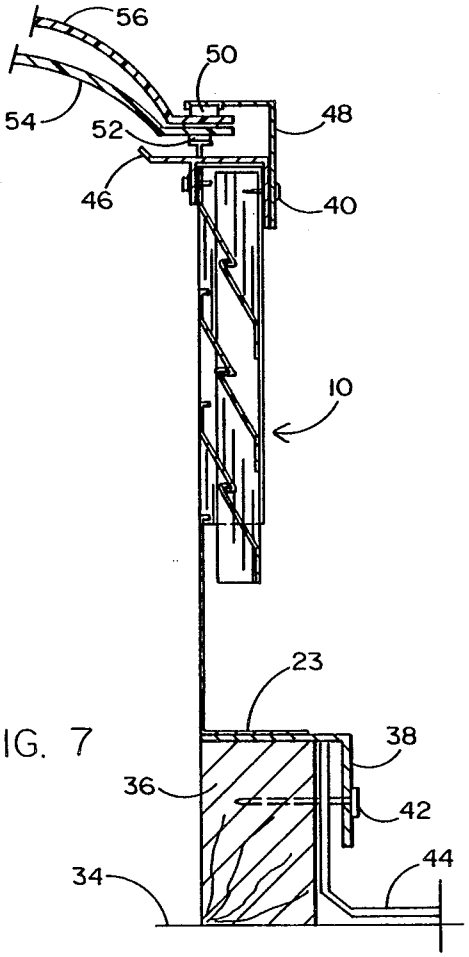
FIG. 7 is a side view of the panel member of the present invention in its fully assembled configuration shown installed on a roof or other such similar structure.
Figure 8:
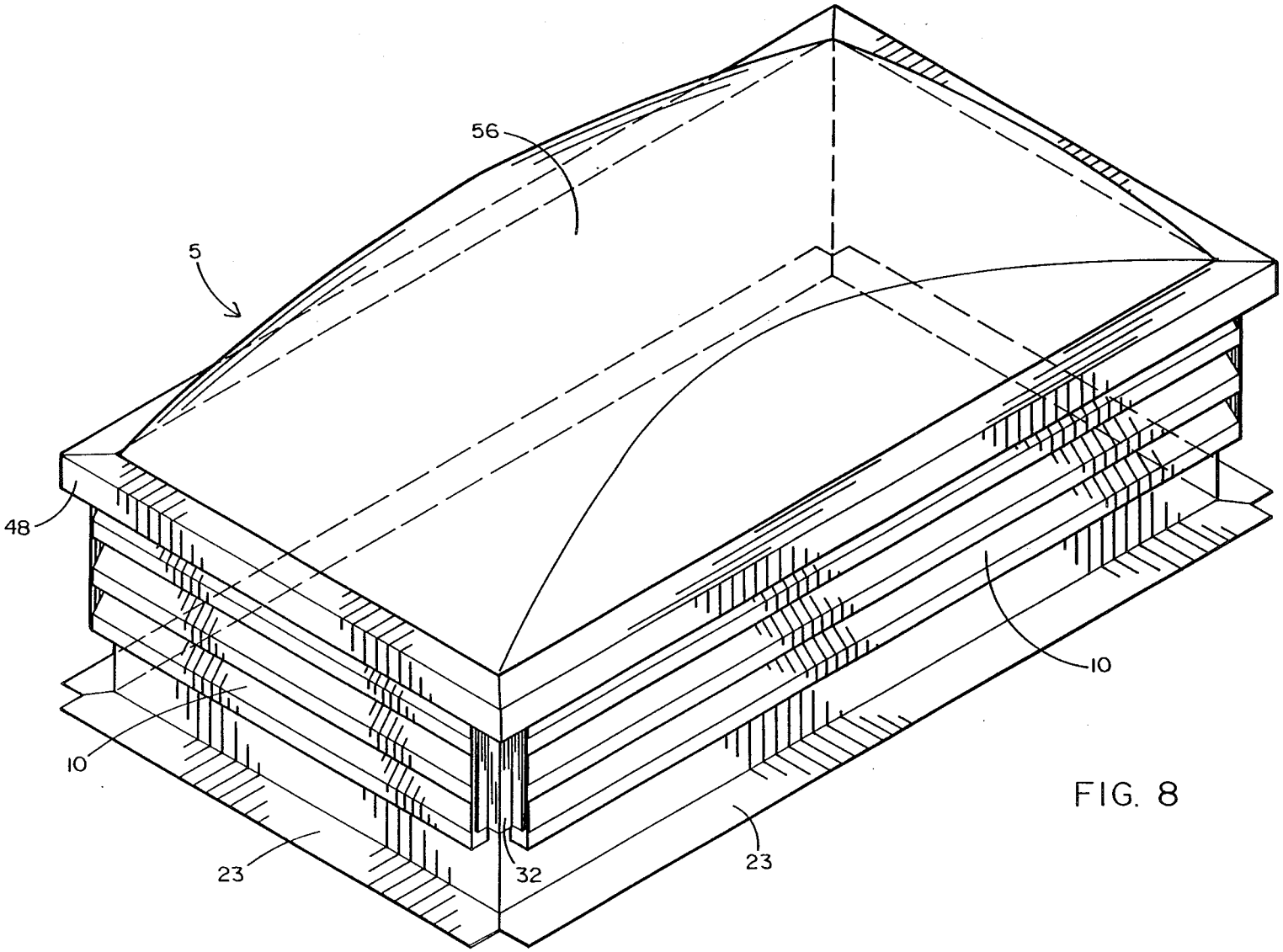
FIG. 8 is a fully assembled louvered skylight structure of the present invention assembled in accordance with the novel method hereof.

After the required number of panels 10 are assembled, a louvered skylight 5 of the present invention may be readily completed and installed on a roof or other similar structure in the manner illustrated in FIGS. 7 and 8. More specifically, as seen in FIG. 7, the bottom member 23 of each panel 10 is secured to a roof interface bracket 38 such as by welding or by fastening elements including screws or nails. Bracket 38 is, in a typical installation, mounted on a wood beam 36 to which it is secured by means such as nails 42 which also affix the assembly to a roof flashing 44 such as by sandwiching a portion of the flashing 44 between bracket 38 and wood beam 36. The top of the panels are provided with an overlying lower bracket 46 and upper bracket 48 to provide skylight supporting beads such as upper bead 50 and lower bead 52 which are designed to support a conventional skylight structure such as skylight members 54 and 56 seen in FIG. 7. The interconnection with a skylight structure above the panel 10 is conventional and well-known in the art and need not be described herein in any greater detail. Suffice it to say that brackets 46 and 48 may be secured to the side panel structure by means of fastening elements 40, typically, metal screws.

The completed skylight structure including four panels 10 and the overlying bracket 48 is shown in FIG. 8. The louvered skylight structure 5 of FIG. 8 illustrates a configuration of the present invention in which there are different lateral dimensions for respective panels 10 to form a rectangular configuration as opposed to the square configuration of FIG. 4. It will be observed that the completed skylight structure 5 has all of the essential features of a desirable louvered structure in that the structure is fully enclosed by a plurality of panels, each providing a plurality of louvers which permit exit of warm air, fumes, or other gases from the structure beneath the roof line through the aperture about which the louvered skylight structure 5 is installed. Yet the louvered structure provides louvers which are not likely to permit any leakage of precipitation or the like into the underlying building because there are no direct horizontal paths through the louvers as best seen in FIGS. 6 and 7. However, unlike the prior art, the desirable structure of the louvered skylight 5 of the present invention is provided in a far simpler method of manufacture and completed structure. More specifically, unlike the prior art, the present invention may be fabricated using the initial step of stamping out flat sheets of suitable material such as aluminum, folding the metal into the desired configuration, connecting the two sections to comprise each panel and then interconnecting the panels in the manner hereinabove disclosed. As a result, the expensive and time consuming manual operations of the prior art are significantly reduced and the skylight structure 5 of the present invention is cheaper and more efficient to manufacture.

It will now be understood that what has been disclosed herein comprises a novel louvered skylight structure and method of manufacturing thereof wherein the structure comprises a plurality of panels each comprising a main section and an extension section. These two sections may be produced starting with the initial step of stamping out and cutting a flat section of suitable material and bending the section into the desired configuration. The sections are configured to provide interlockable lips to provide louvers which are substantially continuous and of sufficient length to preclude any direct horizontal paths through the completed panel whereby warm air, fumes and gases may exit the structure but precipitation, even under the effects of high velocity winds, is generally precluded from entering the structure and leaking into the underlying building.

Those having skill in the art to which the present invention pertains will now, as a result of the applicant's teaching herein, perceive various modifications and additions which may be made to the invention. By way of example, the general concept of utilizing a plurality of sections to comprise each panel may be implemented with other means for interconnecting the sections rather than using the interlocking lip configuration of the sections of the embodiment disclosed herein. Furthermore, particular interconnection devices for affixing one completed panel to another, may be readily provided in a manner which differs from that specifically disclosed herein. Accordingly, all such modifications and additions are deemed to be within the scope of the invention which is to be limited only by the claims appended hereto.

I claim:

1. A louvered panel for a skylight mounted substantially parallel to a roof of a building around an aperture in the roof for permitting ambient light to enter the building while preventing precipitation from entering through the skylight, the panel comprising:

a louvered main section and a louvered extension section, the louvers of the main and extension sections being substantially aligned and having means thereon for interconnection of respective pairs of aligned louvers for forming a plurality of open louvers having angles and spacings which preclude any path therebetween which is about perpendicular to said panel.

2. The panel recited in claim 1 wherein said means for interconnection comprises respective interlocking lips on the louvers of said main section and on the louvers of said extension section.

3. The panel recited in claim 1 further comprising respective side members oriented at about right angles and integral to said sections, said side members being positioned to engage each other in an overlapping contiguous configuration for affixing said main section to said extension section.

4. A louvered skylight enclosure having at least one louvered panel comprising a main section and an extension section, each such section being formed of a planar sheet of material defining a plane and having a plurality of louvers bent at an acute angle relative to the plane of said respective sheet, said louvers of said respective sheets being interconnected between respective pairs of aligned louvers to form a unitary louvered panel having a plurality of interconnected, aligned louvers of sufficient length to preclude any continuous straight path between said louvers in a direction substantially perpendicular to the plane of each said sheet.

5. The enclosure recited in claim 4 further comprising means for interconnecting said louvers of said main section and said louvers of said extension section, respectively.

6. The enclosure recited in claim 5 wherein said means for interconnection comprises respective interlocking lips on the louvers of said main section and on the louver of said extension section.

7. The enclosure recited in claim 4 further comprising respective side members oriented at about right angles and integral to said sections, said side members being positioned to engage each other in overlapping contiguous configuration for affixing said main section to said extension section.

* * * * *